United States Patent [19]

Mosseri et al.

[11] 4,282,637

[45] Aug. 11, 1981

[54] NOZZLE FOR THE TEXTURIZATION OF YARNS

[75] Inventors: Giuseppe Mosseri, Monza; Enrico Lucioni, Cesano Maderno, both of Italy

[73] Assignee: Snia Viscosa Societa' Nazionale Industria Applicazioni Viscosa S.p.A., Milan, Italy

[21] Appl. No.: 944,320

[22] Filed: Sep. 21, 1978

[30] Foreign Application Priority Data

Sep. 21, 1977 [IT] Italy ..... 27748 A/77

[51] Int. Cl.[3] ..... D02G 1/16

[52] U.S. Cl. ..... 28/254; 28/273

[58] Field of Search ..... 28/254, 273, 271, 272, 28/255, 256, 257, 289, 333, 350

[56] References Cited

U.S. PATENT DOCUMENTS

| | | | |
|---|---|---|---|
| 2,982,000 | 5/1961 | Gonsalves | 28/254 |
| 3,259,954 | 7/1966 | Dyer et al. | 28/273 X |
| 3,296,677 | 1/1967 | Chase | 28/255 |
| 3,545,057 | 12/1970 | Lubach | 28/273 |
| 3,577,614 | 5/1971 | Price | 28/273 X |
| 3,669,328 | 6/1972 | Castelli | 28/255 X |
| 3,688,358 | 9/1972 | Kashima et al. | 28/254 X |
| 4,095,319 | 6/1978 | Nelson | 28/273 |
| 4,095,320 | 6/1978 | Polney | 28/273 |

FOREIGN PATENT DOCUMENTS

| | | | |
|---|---|---|---|
| 1263217 | 3/1968 | Fed. Rep. of Germany | 28/273 |
| 26178 | 8/1974 | Italy . | |

*Primary Examiner*—Robert Mackey

*Attorney, Agent, or Firm*—Wenderoth, Lind & Ponack

[57] ABSTRACT

A Venturi type nozzle for the texturization of yarns includes a hollow body to which compressed air is fed, a needle housed therein to which yarn is fed, and a plug, wherein the needle is provided with a longitudinal passage for the yarn, the air passes between the body and the needle, and yarn and air pass through a passage shaped like a Venturi cone in the plug, and wherein mutually facing portions of the needle head and of the plug have frusto-conical surfaces. The ratio of the axial distance between said frusto-conical surfaces to the diameter of the needle orifice is not more than 0.5, and preferably not more than 0.4. Preferably the conicity of the two frusto-conical surfaces is the same. Preferably also the outer surface of the needle head is cut off to provide a plane portion. The needle is axially displaceable and can be fixed in the desired axial position with respect to the body. Preferred dimensions of various portions of the device are defined, also in relationship to the denier of the yarn processed.

11 Claims, 6 Drawing Figures

NOZZLE FOR THE TEXTURIZATION OF YARNS

BACKGROUND OF THE INVENTION (a) The field of the invention

The present invention relates to a nozzle for the texturization of yarns.

By "texturization" is meant, as is known, an operation whereby particular conformation characteristics are imparted to the yarn, to which correspond desired mechanical characteristics: e.g. a crimp to a certain degree and of a certain type which confers a desirable elasticity to yarns made of filaments, in particular synthetic filaments.

(b) The state of the art

It is known to effect such texturization by pneumatic means, particularly by subjecting the yarn to the action of a compressed air jet in a device which is usually called and will be called herein "nozzle", which operates essentially on the principle of a Venturi cone, the yarn being fed to a central passage and the compressed air to a channel which concentrically encompasses it, the air and the entrained yarn passing thereafter through a passage shaped like a Venturi cone, whereby the compressed air entrains the yarn and subjects it to a mechanical action, generally based on the turbulence of the air in the zone of the cone, which produces the desired conformation modifications of the yarn.

U.S. Pat. No. 3,545,057, U.S. Pat. No. 3,863,309, and copending Italian patent application No. 26178 A/74 may be cited among the patents relating to texturization nozzles.

Generally such devices are constituted essentially by three main parts, viz.: a body having a cylindrical cavity constituted by cylindrical parts of different diameters: a so-called "needle" which is inserted in a cavity of the body and has an axial through bore, which may have in its terminal portion a zone or "orifice" having a smaller diameter, the needle generally ending in an outwardly frusto-conical head; and a closure element which will be called herein "plug", which has an axial biconical passage constituted by two generally frusto-conical parts, the first part having a converging and the second a diverging taper (in the direction of the yarn travel), such plug being mounted on the body in such a way as to face with its convergent taper the frusto-conical part of the nozzle head, means being provided for feeding compressed air to the inside of the body and between it and the needle, in such a way that the air may flow out through the biconical passage (Venturi cone) of the plug, entraining therewith the yarn which comes from the axial bore of the needle.

A number of known nozzles of this kind are more or less adapted to produce a texturization effect on the yarn, but their efficiency is not quite satisfactory and for this reason the art has been endeavouring for some time to modify and perfect them to obtain therefrom an improved efficiency. Various proposals have been made to this end; and in particular, e.g., it has been proposed in U.S. Pat. No. 3,863,309 hereinbefore cited, to define on the terminal part of the needle and about the outlet of its axial bore, a frusto-conical cavity having a taper opposed to that of the outer surface of the needle head, for the purpose of creating at the point at which the yarn comes out of the needle, a chamber wherein the air may have turbulences which, according to such patent, improve the efficiency of the nozzle.

In spite of all this, all known nozzles, including the most improved ones, have the common drawback of a high consumption of compressed air, which substantially affects the economy of the process. The precise reasons of such an excessive consumption are not clear, and even though applicants will set forth a hypothesis regarding it, they do not wish to be bound to its accuracy, the only relevant fact being that the compressed air consumption is actually high and that it is desirable to reduce it. This phenomenon is particularly evident when a yarn is produced that will be called hereinafter "binary yarn", viz. a yarn made of two components which are fed with different speeds or more precisely with different overfeeds, so that the final yarn is composed of two coupled yarns having different lengths in an extended condition, one of which therefore has significantly more marked deformations, crimps and bends than the other.

It is an object of the present invention to provide a nozzle for the texturization of yarns, of the Venturi cone type, wherein the compressed air consumption is significantly reduced, for a given production, with respect to all known devices.

It is a further object of the present invention to provide a device of the above type which can be regulated precisely and easily.

It is a further object of the invention to provide a device of the above type which is adapted to the production of binary yarns in a wide range of counts.

It is a further object of the present invention to provide a device of the above type which is economical, simple, and reliable in operation.

SUMMARY OF THE INVENTION

The invention is essentially characterized in that, in a nozzle of the type under consideration and which comprises a body, a needle, and a plug, wherein the needle is provided with a longitudinal bore for the passage of the yarn and the plug is provided with a Venturi cone passage for the air and for the yarn, and wherein the needle head is outwardly bound by a convergent frusto-conical surface and the portion of the plug facing it is provided with another frusto-conical surface, the ratio of the axial distance between the aforesaid frusto-conical surfaces (as defined hereinafter) to the diameter of the needle orifice is not greater than 0.5 and preferably is not greater than 0.4.

In a preferred form of the invention, the conicities of the frusto-conical surfaces are equal.

In another preferred form of the invention, the ratio of the diameter of the minimum cross-section of the Venturi cone to the diameter of the needle orifice is not more than 1.5.

According to another preferred form of the invention, the outer surface of the needle head is recessed to provide a portion of a plane surface lying on a plane parallel to a plane tangent to the original frusto-conical surface of the needle head.

According to a further preferred form of the invention, the needle is provided with means for displacing it axially with respect to the needle body and for fixing it in the desired axial position, corresponding to a predetermined axial distance between the frusto-conical surface of the tip of the needle and the surface of the Venturi cone facing it.

In a further preferred form of the invention, the air stream and the yarn coming out of the needle are deviated by a deflector facing the outlet orifice of the Venturi cone, in a direction substantially perpendicular to the nozzle axis.

According to another preferred form of the invention, means are provided for assuring air-tightness between the needle and the nozzle body upstream of the zone in which compressed air is fed to the nozzle and between the plug and the nozzle body.

According to other preferred forms of the invention, the diameters of the air orifice and of the minimum cross-section of the Venturi cone and the axial distance between the frusto-conical surface of the needle tip and the frusto-conical surface of the Venturi cone, are comprised within absolute values which will be stated hereinafter.

BRIEF DESCRIPTION OF THE DRAWINGS

The aforesaid and other objects as well as the characteristics and advantages of the invention, will appear more fully from the following description of a preferred embodiment, with reference to the appended drawings wherein.

DETAILED DESCRIPTION OF THE INVENTION

Figure 1:
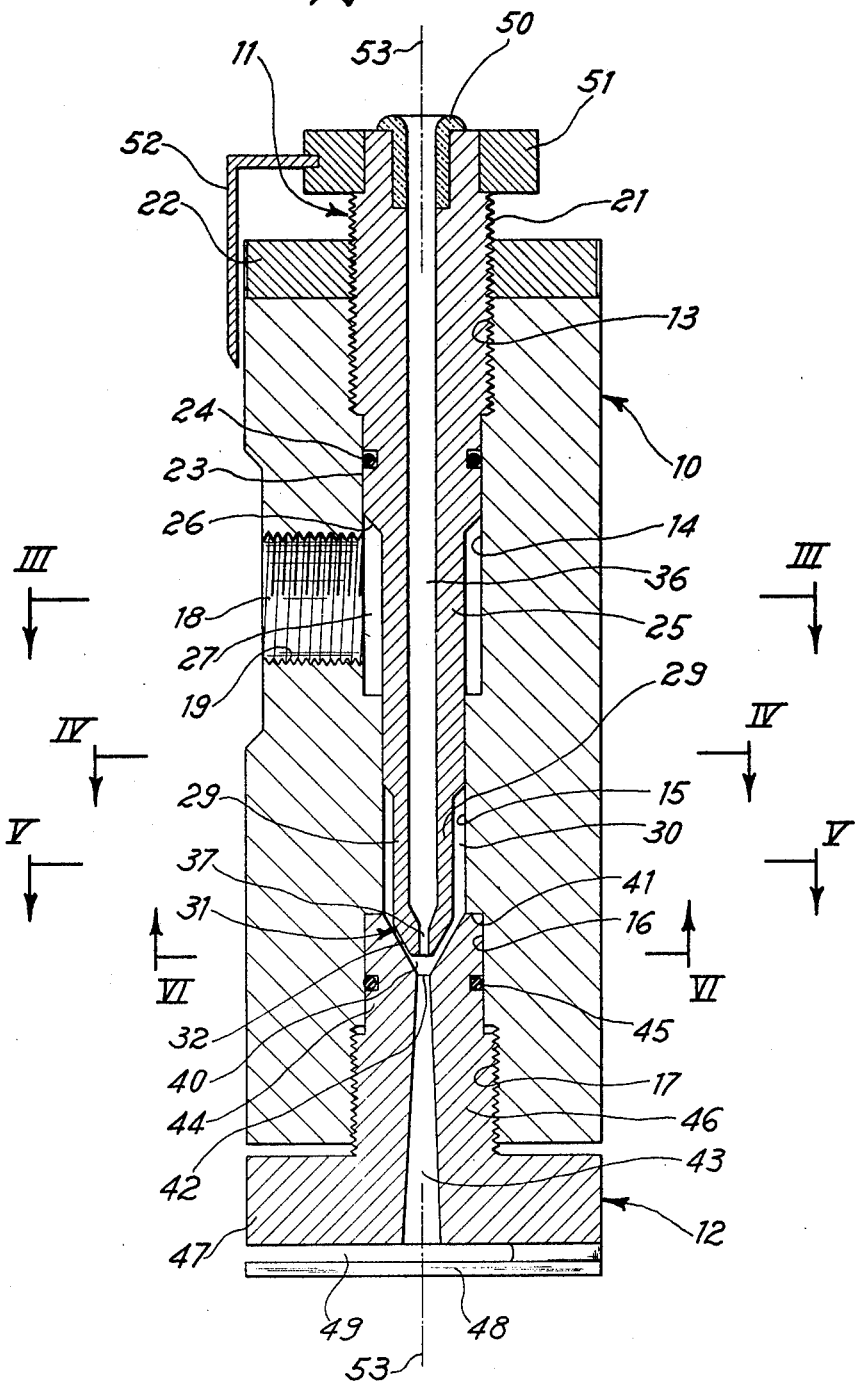
FIG. 1 is an axial cross-section of a nozzle according to an embodiment of the invention.

With reference firstly to FIGS. 1 and 3 to 5, the nozzle is essentially constituted by a body generally indicated at 10, by a needle generally indicated at 11, by a plug generally indicated at 12. The whole is symmetric with respect to axis 53.

The body 10 is traversed by a cavity constituted by a succession of cylindrical segments having different diameters, some of them being threaded: for the sake of illustrative clarity, the numbers which identify the several segments will be referred in the drawings to the cylindrical surfaces which respectively bound such segments. Going from upstream to downstream, viz. proceeding in the direction of travel of the yarn (downwards with reference to FIG. 1) the cavity has a first segment 13 which is threaded, a cylindrical second segment 14 having a diameter slightly smaller than that of the threaded portion, a cylindrical third segment 15 having a smaller diameter, a cylindrical fourth segment 16 having a diameter greater than that of segment 15 and in the specific embodiment illustrated having the same diameter as segment 14, and a last, threaded segment 17 having a slightly larger diameter than segment 16. Further, the body is provided with a lateral passage 18 for the feeding of compressed air (or another gas), particularly well seen in FIG. 3, which may be provided with a thread 19 for connecting it to a source of compressed air, not illustrated and anyway conventional, and which conveys the air to the segment 14 of the axial cavity of the nozzle body.

The needle 11 has a thread 21 in its upstream portion, which is the maximum diameter portion, which thread is adapted to engage the female thread of the segment 13 of the body, and on which a ring 22 and a ceramic thread guide 50 are mounted, for purposes that will be set forth hereinbelow.

Proceeding in the direction of the yarn travel, the needle has an upper cylindrical surface 23 which has the same diameter as the segment 14 of the body cavity and engages it tightly, an air-tight gasket 24 being provided in this zone. Proceeding further, the shape of the needle changes and it acquires, as particularly shown in FIG. 3, a square outer cross-section in the zone indicated at 25, the diagonal of the square being equal to the diameter of the segment 15 of the body cavity, and the square cross-section portion axially extending sufficiently to engage at least a part of the aforesaid segment 15. A suitably shaped surface 26 connects the cylindrical surface 23 to the square outer surface of the segment 25.

As is seen, a substantially annular chamber 27 having a prismatic inner surface and a cylindrical outer surface is formed between the segment 25 of the needle and the segment 14 of the body cavity, in which chamber the compressed air which enters the passage 18 of the nozzle body flows. From chamber 27 the air can proceed longitudinally along the body cavity through the circular segments 28 (FIG. 4) which remain free between the outer square surface of the segment 25 of the needle and the inner cylindrical surface of the segment 15 of the body.

Figure 2:
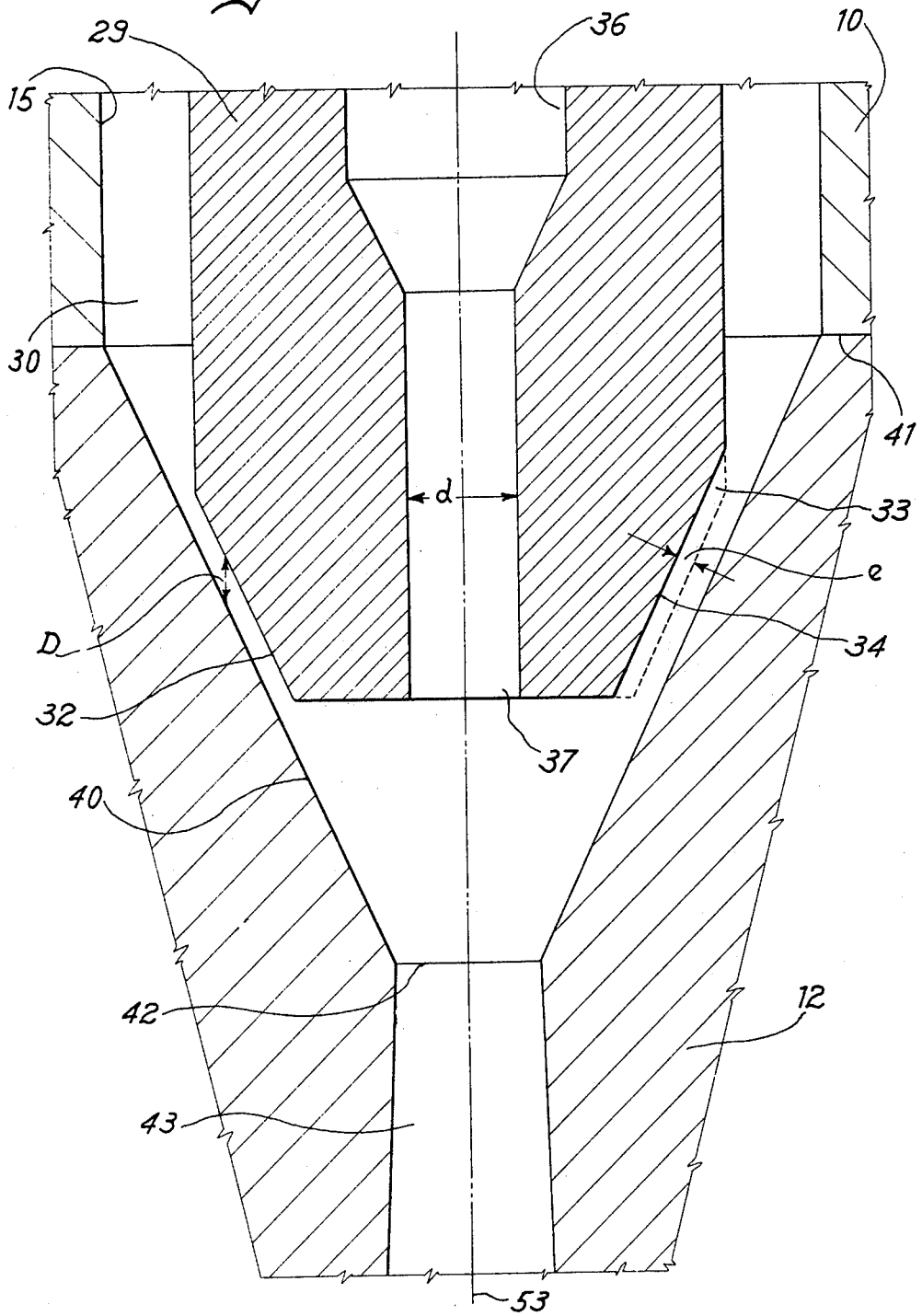
FIG. 2 is a detailed view of a portion of FIG. 1 shown on a larger scale for the purpose of illustrating more clearly certain critical dimensions of the nozzle of FIG. 1.
Figure 3:
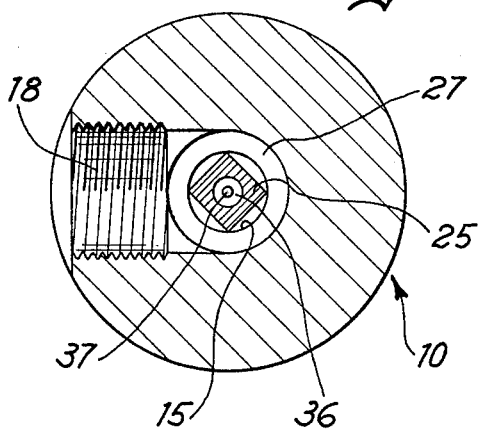
FIGS. 3, 4, and 5 are transverse cross-sections of the device of FIG. 1, taken respectively on planes III—III, IV—IV, and V—V of FIG. 1 looking in the direction of the arrows.
Figure 4:
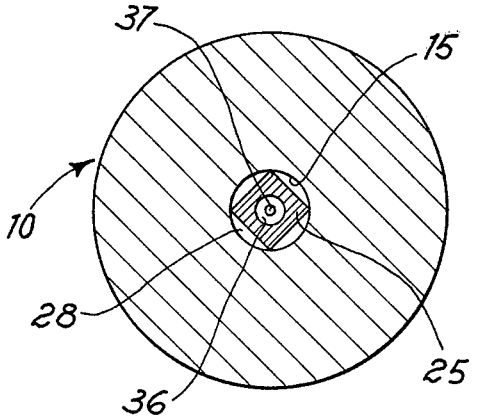
Figure 5:
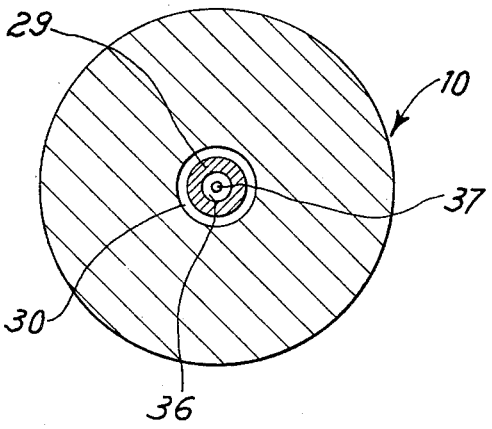
Figure 6:
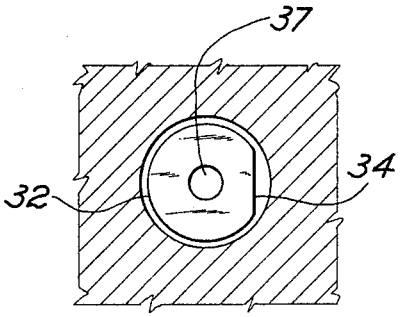
FIG. 6 is a further cross-section of the device of FIG. 1, on an enlarged scale, taken on the plane VI—VI of FIG. 1 looking in the direction of the arrows, wherein only the needle and the inner portion of the plug are shown.

Still proceeding in the direction of the yarn motion, the needle has a further cylindrical segment 29, having a smaller diameter than the inner diameter of the segment 15 of the body, so that an annular chamber 30 is defined between needle and body through which the air may flow, and finally has a tip or head generally indicated at 31 which possesses a frusto-conical outer surface 32 which however has been modified, as seen in FIGS. 2 and 6, by removing therefrom a portion 33, to create a surface 34 defined by a plane parallel to a plane which is tangent to the original frusto-conical surface 32 (FIG. 2).

The needle is traversed by an axial bore 36 which may have portions of different diameters, and is generally provided with a final portion or orifice 37, having a smaller diameter, in correspondence with the needle head or tip, the segments of the passage having different diameters being suitably interconnected, e.g. by frusto-conical surfaces.

The plug 12 has a first convergent frusto-conical surface 40 which faces the frusto-conical surface 32 of the needle head and has preferably the same conicity as this latter. Preferably, around the outlet of surface 40 is located an annular surface 41 which abuts on a corresponding shoulder of the nozzle body. The passage 42, which marks the end of the frusto-conical surface 40, represents the minimum cross-section of the axial passage of the plug, and from then on, such passage widens out to form a frusto-conical opening having its taper in the opposite direction to that of the surface 40, which opening is indicated at 43 and constitutes the expansion portion of a Venturi cone, according to well known principles.

Outwardly, plug 12 has a first, cylindrical segment 44 having the same diameter as segment 16 of the cavity of the nozzle body and in contact therewith, a gasket 45 being provided to assure air-tightness. Further on, the plug has an outwardly threaded segment 46 which engages the thread of the cavity 17 of the nozzle body. Finally, the plug flares out to form a head 47 located outside the nozzle body and normally not in contact therewith. Preferably the plug carries a deflector 48 which faces the outlet of the conical segment 43 to form a restricted gap 49 through which the air and the yarn coming out of segment 43 are laterally discharged, the yarn being subsequently taken up by suitable collecting means, not illustrated because they are conventional.

In the embodiment shown in the drawings, the plug is in a fixed position when in operating condition, because its annular surface 41 is in contact with an abutment shoulder of the nozzle body. This is preferred but is not indispensable and the dimensional relationships between the needle and the plug, which will be specified, could also be obtained by means of a plug which has a controllable operating position. It is preferred, however, that the plug be fixed and the needle be axially controllable. The needle can be shifted axially by rotating it and taking advantage of the engagement of its outer thread 21 with the thread of the segment 13 of the nozzle body. The needle 11 fixedly carries on its upstream end the preferably ceramic thread guide 50 for facilitating the introduction of the yarn into passage 36, and a knurled ring 51 provided with an index 52. Index 52 indicates the angular position of the ring with respect to a scale, not illustrated, marked on the outside of the body 10, and therefore, due to the engagement of the thread 21 with the inner thread of the segment 13 of body 10, it indicates the axial position of the ring on the nozzle body. Once the aforesaid position has been reached, the ring 22 is turned as far as it will go and fixes the needle in its working position. Ring 51 is preferably used as an index to define the desired axial position of the needle since it rotates with the needle and there is therefore a relationship between its angular displacement and the axial displacement of the needle.

In the aforesaid position shown in the drawings, the frusto-conical surface 32 of the needle head, in the portion thereof which has not been modified, viz. excluding the portion 34, has a certain axial distance from the convergent frusto-conical surface 40 of the plug, which faces it. By "axial distance" of such two surfaces is meant their distance measured on any straight line parallel to the axis of the device, and thus the distance is represented e.g. by segment "D" in FIG. 2.

The device may be manufactured from any suitable metal materials, but preferably the materials used are as follows. The needle is made of steel and the needle tip is hardened. The inner portion of the needle tip is not polished. The plug is made of hardened steel internally finished with a mirror polish, while the deflector 48 may be conveniently made of brass polished and chromium plated to desired thickness. The nozzle body is preferably of brass and the rings 22 and 51 may also be of brass. The steels used are preferably stainless.

It is critical, according to the invention, that there should be a specified ratio of the axial distance "D" between the needle tip and the convergent cone 40 of the Venturi device to the diameter of the needle orifice, which is indicated in the drawings by numeral 37, which diameter will be represented by the letter "d" (see FIG. 2). Such ratio must not be greater than 0.5 and preferably should not be greater than 0.4.

In addition to the aforesaid critical condition, the further condition is preferably observed that the ratio of the diameter of the minimum cross-section of the Venturi cone, viz. the diameter of the cross-section 42, which will be represented hereinafter by "$d_v$", to the inner diameter "d" of the needle tip, should not be greater than 1.5.

Preferably, further, the axial distance "D" is comprised between a minimum of 0.2 mm and a maximum of 0.5 mm for processing yarns having relatively low, viz. lower than 1000, denier, while for yarns having relatively high, e.g. between 1000 and 3000, denier, the distance "D" may increase up to a maximum of 1 mm.

The inner diameter "d" of the needle tip is preferably about 1 mm or slightly less, while for high counts it will preferably be more than a millimeter and may be in the range of a few tenths of a millimeter more or less than an average dimension of 1.5 mm.

The cut along a plane parallel to a plane tangent to the needle tip, more clearly shown in FIG. 6, is preferably such that the distance "e" between the original or theoretical surface indicated at 32 and the finished surface 34, measured perpendicularly to such surface (see FIG. 2) be not greater than 0.4 d and not smaller than 0.2 d, preferably about 0.3 d. The presence of this cut causes, for reasons which cannot be detected technically, a significant improvement in the nozzle efficiency in terms of product quality and air consumption.

The dimensions of the channels for the passage of the air are not equally critical and may easily be determined by a person skilled in the art, but anyway it may be noted that the overall area of the four passages 28 having the shape of circular segments is preferably slightly larger than the sum of the areas of the needle orifice 37 and of the minimum cross-section 42 of the Venturi cone.

In the operation of a device according to the dimensional characteristics hereinbefore set forth, a supersonic flow is created—according to what has been determined—at least in the annular cross-section between the needle tip and the convergent Venturi cone.

The operation of the nozzle according to the embodiment of the invention which has been described, may be evaluated from a number of yarn texturization examples set forth in the following Table 1 relating to binary polycaproamide (polyamide 6), ethylene polyterephthalate (polyester) and viscose rayon yarns. The table indicates the deniers and the filament numbers of two yarns A and B, which are generally matte but which may be glossy, as indicated, the degrees of overfeed in percentages for the two yarns, viz. the percentage by which the feed speed of each yarn exceeds the wind-up speed of the texturized yarn, the overall denier of the binary yarn which is discharged from the nozzle, the axial distances "D" between needle and Venturi cone, the air consumption in normal cubic meters per kilogram of yarn. In all the eight examples listed, the inner diameter of the needle head, "d", was 1 mm and the diameter of the minimum cross-section 42 of the Venturi cone was 1.3 mm, the yarn speed at the outlet was 150 meters per minute, and the pressure of the air feed was 3.5 atmospheres.

Table 2 illustrates two further examples in which the air pressure was 9 atmospheres and the yarn speeds at the outlet were as indicated in the last column of the Table. t,0170 t,0190

Table 1

| Yarns: chemical composition | | Deniers | Over-feeds mm. | Outlet Deniers | Axial distances mm. | Air Consumption $Nm^3$ per Kg. of yarn | Example No. |
|---|---|---|---|---|---|---|---|
| Polyamide 6 | A | 70/24 r.m. | + 6 | 156 | 0.38 | 24.5 | 1 |
| | B | 70/24 r.m. | +22 | | | | |
| Polyamide 6 | A | 70/18 r.m. | + 8 | 155 | 0.46 | 27.3 | 2 |
| | B | 70/18 r.m. | +22 | | | | |
| Polyamide 6 | A | 140/72 r.m. | +10 | 312 | 0.35 | 12.1 | 3 |
| | B | 140/72 r.m. | +20 | | | | |
| Polyester | A | 70/24 r.m. | +12 | 160 | 0.38 | 24.5 | 4 |
| | B | 70/24 r.m. | +25 | | | | |
| Polyester | A | 70/40 r.m. | + 8 | 159 | 0.32 | 20 | 5 |
| | B | 70/40 r.m. | +22 | | | | |
| Polyamide 6 | A | 210/40 r.m. | + 8 | 625 | 0.31 | 6.77 | 6 |
| Visscose Rayon | B | 300/44 glossy | +48 | | | | |
| Polyester | A | 150/32 r.m. | + 9 | 430 | 0.28 | 7.29 | 7 |
| Viscose Rayon | B | 200/44 glossy | +46 | | | | |
| Polyamide 6 | A | 70/24 r.m. | +17 | 155 | 0.36 | 23 | 8 |
| Polyester | B | 70/40 r.m. | +34 | | | | |

Note: "r.m." signifies "round matte."

Table 2

| Yarns: chemical composition | | Deniers | Over-feeds mm. | Outlet Deniers | Axial distances mm. | Air Consumption $Nm^3$ per Kg. of yarn | Example No. |
|---|---|---|---|---|---|---|---|
| Polyamide 6 9 | A | 70/24 r.m. | +12 | 160 | 0.21 | 14.5 | 450 |
| | B | 70/24 r.m. | +39 | | | | |
| Same 10 | A | same | +12 | 154 | 0.21 | 11 | 600 |
| | B | same | +39 | | | | |

Note: "r.m." signifies "round matte."

The air consumptions indicated in the preceding Tables are much smaller, all things being equal, than those of the previously known nozzles. It may be said that the consumptions are cut to less than one half by means of the invention.

The Applicants do not wish to be bound to any explanation of the reasons why the invention achieves the result which it does achieve. However, it appears likely that while in the previously known nozzles the texturization occurred essentially as a consequence of the turbulence of the air in the zone between the nozzle head and the Venturi cone, as confirmed by the fact that one means for improving the nozzle efficiency consisted in improving the conditions of turbulence, as indicated in U.S. Pat. No. 3,863,309, in the nozzle according to the invention the effect of the turbulence is supplemented to a decisive degree by a yarn-wall interaction. In other words, although it is evident that in any nozzle of the type in question there are air turbulences which have a certain effect on the yarn and there are contacts between yarn and walls, in the preceding nozzles the determining factor was the turbulence of the air, whereas in the nozzle according to the invention the relationship of the yarn to the walls acquires a much greater and probably a decisive importance. The efficacy of the yarn-wall interaction does not depend proportionally on the amount of air that is fed, whereas the effects of the turbulence clearly depend on such amount to a much greater degree. Further, the determining efficacy of the yarn-wall interaction makes the formation of turbulence chambers useless and makes it possible to reduce the air passages, which produces an economy in the air consumption.

The critical importance of the distance between the two conical surfaces of the needle and the Venturi cone lends a particular interest to the possibility of easily controlling with precision the position of the needle, as hereinbefore indicated. As has been said, the plug, too, could be axially displaceable, but this would cause a useless complication and it is preferred to avoid it.

Although an embodiment of the invention has been described by way of illustration, the invention could be carried into practice by skilled persons with numerous variations, modifications and adaptations without exceeding the scope thereof.

We claim:

1. A Venturi type nozzle for texturizing yarns, said nozzle comprising:

a hollow body having therein an axial cavity;

an elongated needle extending into said cavity, said needle having therethrough an axial bore for the passage of yarn, said needle having a head end having an inner orifice and an outer surface including a first convergent frustoconical surface;

a plug connected to said body, said plug having therethrough a convergent-divergent Venturi passage including a second convergent frusto-conical surface facing said first frusto-conical surface and spaced therefrom to define a substantially frusto-conical chamber, a downstream divergent frusto-conical surface, and a minimum cross-section separating said convergent and divergent frusto-conical surfaces;

the conicities of said first and second frusto-conical surfaces being equal;

a lateral passage extending into said body for supplying thereinto a gas;

passage means, between the interior of said body and the exterior of said needle, for directing gas supplied through said lateral passage to and through said frusto-conical chamber and through said minimum cross-section and said divergent frusto-conical surface, to thereby withdraw yarn from said orifice of said needle, said passage means being arranged symmetrically with respect to the longitudinal axis of said needle from said lateral passage to the upstream end of said frusto-conical chamber;

the ratio of the axial distance between said first and second convergent frusto-conical surfaces, measured on a straight line parallel to said longitudinal axis of said needle, to the diameter of said needle orifice being not greater than 0.5; and said needle including a segment having a polygonal cross-section including vertices engaging a circular cylindrical wall defining said cavity of said body and flat surfaces spaced from said cylindrical wall and defining therebetween elongated chambers which at least partially define said passage means, the total free cross-sectional area of said elongated chambers, through which area said gas flows, being slightly larger than the sum of the areas of said needle orifice and said minimum cross-section.

2. A nozzle as claimed in claim 1, wherein said ratio is not greater than 0.4.

3. A nozzle as claimed in claim 1, wherein the ratio of the diameter of said minimum cross-section to said diameter of said needle orifice is not greater than 1.5.

4. A nozzle as claimed in claim 1, wherein said outer surface of said needle head end is cut off to provide a portion of a plane surface lying on a plane parallel to a plane tangent to the original frusto-conical surface.

5. A nozzle as claimed in claim 1, wherein said needle is provided with means for displacing said needle axially with respect to said body and for fixing said needle in a desired axial position with respect to said body, corresponding to a predetermined said axial distance between said first and second convergent frusto-conical surfaces.

6. A nozzle as claimed in claim 1, wherein said plug is provided with deflector means, facing the outlet orifice of said Venturi passage, for deflecting a stream of air and yarn issuing therefrom in a direction perpendicular to said axis.

7. A nozzle as claimed in claim 1, further comprising means for assuring air-tightness between said needle and said body upstream of said lateral passage and between said plug and said body.

8. A nozzle as claimed in claim 1, for yarns having deniers smaller than 1000, wherein said axial distance between said first and second convergent frusto-conical surfaces is between 0.2 and 0.5 mm.

9. A nozzle as claimed in claim 1, for yarns having deniers between 1000 and 3000, wherein said axial distance between said first and second convergent frusto-conical surfaces is not greater than 1 mm.

10. A nozzle as claimed in claim 1, for yarns having deniers not larger than 1000, wherein said diameter of said orifice of said needle is approximately 1 mm.

11. A nozzle as claimed in claim 1, for yarns having deniers above 1000, wherein said diameter of said orifice of said needle is approximately 1.5 mm.

* * * * *